US007230385B2

(12) United States Patent
Sobieradzki et al.

(10) Patent No.: US 7,230,385 B2
(45) Date of Patent: Jun. 12, 2007

(54) COLLECTOR ARRANGEMENT

(75) Inventors: Edward Stanley Sobieradzki, Colchester (GB); Stephen Bardell, Barnston (GB); Steven Aitken, Chelmsford (GB); Alan Edward Wheelhouse, Braintree (GB)

(73) Assignee: E2V Technologies (UK) Limited, Chelmsford (GB)

( * ) Notice: Subject to any disclaimer, the term of this patent is extended or adjusted under 35 U.S.C. 154(b) by 0 days.

(21) Appl. No.: 11/506,929

(22) Filed: Aug. 21, 2006

(65) Prior Publication Data

US 2006/0279219 A1 Dec. 14, 2006

Related U.S. Application Data

(63) Continuation of application No. 10/792,902, filed on Mar. 5, 2004, now abandoned.

(30) Foreign Application Priority Data

Feb. 27, 2004 (GB) ..... 0404426.9

(51) Int. Cl.
*H01J 23/02* (2006.01)

(52) U.S. Cl. ..... 315/5.38; 315/3.5

(58) Field of Classification Search ..... 315/5.38, 315/3.5, 5.14

See application file for complete search history.

(56) References Cited

U.S. PATENT DOCUMENTS 3,806,755 A 4/1974 Lien et al.
3,936,695 A 2/1976 Schmidt
3,993,925 A * 11/1976 Achter et al. ..... 315/5.38
4,107,574 A 8/1978 Ruf et al.
4,398,122 A 8/1983 Gosset
4,413,207 A 11/1983 Kageyama et al.
4,417,175 A 11/1983 Curren et al.
4,494,039 A 1/1985 Kim
4,584,473 A 4/1986 Hashimoto et al.
4,607,193 A 8/1986 Curren et al.
4,794,303 A 12/1988 Hechtel et al.
5,177,394 A 1/1993 Kubo
5,568,014 A 10/1996 Aoki et al.
5,684,364 A 11/1997 Heppinstall et al.
5,859,498 A 1/1999 Durand et al.
5,942,852 A 8/1999 Goebel et al.
6,208,079 B1 * 3/2001 Brown, II ..... 315/3.5
6,262,536 B1 7/2001 Symons
6,462,474 B1 10/2002 Symons
6,617,791 B2 9/2003 Symons (Continued)

FOREIGN PATENT DOCUMENTS

DE 31 46 475 A1 6/1983

(Continued)

*Primary Examiner*—Trinh Vo Dinh
(74) *Attorney, Agent, or Firm*—Venable LLP; Robert Kinberg; Steven J. Schwarz

(57) ABSTRACT

A collector for an electron beam tube comprises a plurality of electrode stages. The electrode stages are spaced from one another by a non-conductive spacer. The non-conductive spacer is located between portions of electrodes and extends into the collector on a first side and out of the collector on a second side. The non-conductive spacer has an inner portion extending into the collector and an outer portion extending out of the collector and a waisted portion there between. The spacer is held at the waisted portion.

21 Claims, 4 Drawing Sheets

U.S. PATENT DOCUMENTS

| | | | | |
|---|---|---|---|---|
| 6,653,787 | B2 * | 11/2003 | Watkins et al. | 315/5.38 |
| 6,879,208 | B2 | 4/2005 | Wilson et al. | |
| 6,998,783 | B2 * | 2/2006 | Symons | 315/5.37 |
| 2002/0008478 | A1 * | 1/2002 | Schult | 315/5.37 |
| 2002/0180362 | A1 | 12/2002 | Symons | |
| 2003/0090208 | A1 | 5/2003 | Wilson et al. | |
| 2003/0122491 | A1 | 7/2003 | Ives | |
| 2004/0174211 | A1 | 9/2004 | Symons | |

FOREIGN PATENT DOCUMENTS

| | | |
|---|---|---|
| DE | 39 13 063 | 10/1990 |
| EP | 0 020 218 | 12/1980 |
| FR | 2742580 | 6/1997 |
| FR | 2 834 122 | 6/2003 |
| GB | 819682 | 9/1959 |
| GB | 1 215 020 | 12/1970 |
| GB | 1 482 801 | 8/1977 |
| GB | 1 493 065 | 11/1977 |
| GB | 2 369 488 | 5/2002 |
| JP | 56-19850 | 2/1981 |
| JP | 63-939 | 1/1988 |
| JP | 63-213242 | 9/1988 |
| JP | 1-309233 | 12/1989 |
| JP | 4-359839 | 12/1992 |
| JP | 5-2986 | 1/1993 |
| JP | 6-20612 | 1/1994 |
| JP | 6-150837 | 5/1994 |
| JP | 9-104978 | 4/1997 |

* cited by examiner

COLLECTOR ARRANGEMENT

CROSS-REFERENCE TO RELATED APPLICATION

This application is a continuation of U.S. patent application Ser. No. 10/792,902, filed Mar. 5, 2004, now abandoned, which claims the priority of United Kingdom Patent Application No. 0404426.9, filed Feb. 27, 2004, priority of which is also claimed herein. The disclosure of each of the foregoing applications is incorporated herein by reference.

BACKGROUND OF THE INVENTION

The present invention relates to collector arrangements for electron beam tubes. In particular, the invention relates to arrangements for efficiently collecting electrons whilst avoiding negative effects due to secondary emission of electrons.

Electron beam tubes are used for the amplification of RF signals and are typically linear beam devices. There are various types of linear electron beam tube known to those skilled in the art, two examples of which are the klystron and the Inductive Output Tube (IOT). Linear electron beam tubes incorporate an electron gun for the generation of an electron beam of an appropriate power. The electron gun includes a cathode heated to a high temperature so that the application of an electric field between the cathode and an anode results in the emission of electrons. Typically, the anode is held at ground potential and the cathode at a large negative potential of the order of tens of kilovolts.

Electron beam tubes used as amplifiers broadly comprise three sections. An electron gun generates an electron beam, which is modulated by application of an input signal. The electron beam then passes into a second section known as the interaction region, which is surrounded by a cavity arrangement including an output cavity arrangement from which the amplified signal is extracted. The third stage is a collector, which collects the spent electron beam.

In an inductive output tube (IOT) a grid is placed close to and in front of the cathode, and the RF signal to be amplified is applied between the cathode and the grid so that the electron beam generated in the gun is density modulated. The density modulated electron beam is directed through an RF interaction region, which includes one or more resonant cavities, including an output cavity arrangement. The beam may be focused by a magnetic means to ensure that it passes through the RF region and delivers power at an output section within the interaction region where the amplified RF signal is extracted. After passing through the output section, the beam enters the collector where it is collected and the remaining power is dissipated. The amount of power which needs to be dissipated depends upon the efficiency of the linear beam tube, this being the difference between the power of the beam generated at the electron gun region and the RF power extracted in the output coupling of the RF region.

The difference between an IOT and a Klystron is that in an IOT, the RF input signal is applied between a cathode and a grid close to the front of the cathode. This causes density modulation of the electron beam. In contrast, a klystron velocity modulates an electron beam, which then enters a drift space in which electrons that have been speeded up catch up with electrons that have been slowed down. The bunches are thus formed in the drift space, rather than in the gun region itself.

In IOT, Klystrons and other linear beam tube types such as TWTs, the efficiency of collection of the electron beam can be improved by using a multi-stage depressed collector. In such an arrangement, there is a plurality of electrically isolated stages or electrodes, each operating at a potential at or between ground and the cathode potential. In one such typical arrangement, a collector has five stages, the difference in potential between the various stages being 25% of the beam voltage. By using such a multi-stage depressed collector, the electrons in the beam are slowed down before impacting on the electrode surfaces, thus leading to greater recovery of energy. Collectors may, of course, have a different number of stages operating at different potentials. The term "depressed" is used in the sense that the voltage at which each electrode is held is "depressed" in relation to ground potential.

We have appreciated the need to improve the efficiency of electron collection in an electron beam tube.

SUMMARY OF THE INVENTION

The invention is defined in the claims to which reference is now directed.

In its various aspects, the invention resides in techniques to improve operation of a collector. Such improvements include reducing the occurrence of secondary electrons, reducing the ability of such electrons to interfere with operation of the device and to ensure efficient collection of the electron beam without requiring unwieldy shielding around the collector.

An embodiment of the invention includes various aspects as are now described.

In a first aspect, one or more portions of the interior surface of the collector, or the whole interior surface is coated with a coating having a low secondary electron emission characteristic. Typical coatings include, but are not limited to titanium and titanium nitride. The use of such a coating assists in reducing the number of secondary electrons emitted when electrons from the electron beam strike the collector surface. A secondary electron is an electron emitted when energy from a primary, (incident) electron striking the surface is given up and causes emission of a (secondary) electron from the surface.

The choice of coating, we have appreciated, also improves performance by trapping any stray gas in the vacuum enclosure of the collector. Such a material is known as a "getter" of which titanium is a good example.

In a second aspect, the electrode stages of the collector are arranged such that there is a gap between electrodes so arranged that there is no direct line of sight of the electron beam, as deflected by any of the fields in the collector cavity which could possibly fall between the electrodes. In essence, the electrodes "overlap" such that there is a sufficient gap between them to hold off the high voltage differential that exists between the electrodes, but the gap does not allow electrons to pass through because there is no feasible electron path to do so. This aspect ensures that electrons are collected efficiently and spent electrons are not allowed to strike portions of the collector outside of the collector electrode arrangement which could cause unwanted effects, such as X-ray generation.

A third aspect, resides in the choice of shape and arrangement of an insulating component between electrodes of the collector. This component, typically of ceramic, has a relatively short physical path as a barrier between electrodes on the vacuum side of the chamber and a relatively longer path outside of the vacuum. We have appreciated that this arrangement provides the best use of material because the physical path length in a vacuum does not need to be as long as the physical path length in standard atmospheric gases to hold off the same high voltage. This component also provides a capacitance between electrodes, which provides a short circuit to RF frequencies but an open circuit to DC voltages.

In a fourth aspect, the drift tube portion of the linear beam device is arranged so that any secondary electrons, which are emitted from electrode surfaces, are more likely to be trapped by a wall of the drift tube and less likely to enter the RF output interaction space. Specifically, the aperture of the drift tube through which the electron beam passes is made relatively narrow in comparison to prior arrangements.

The fifth aspect resides in the connections between electrodes of the collector arrangement, and specifically the High Voltage (HV) leads which supply the high voltages to the electrodes. To remove unwanted frequencies, components are coupled to the HV leads so as to act as a filter typically for frequencies around 10 MHz.

In a last, sixth aspect, a support is provided for the collector arrangement within its grounded housing. Such a support or spacing is not typically provided in linear beam devices because the device is typically transported without the outer housing in place, or the outer housing is an integral aspect of the device. In consequence of changing the conventional arrangement of the collector assembly, we have appreciated the importance of providing stability of the collector within a housing, whilst maintaining a good electrical insulation.

BRIEF DESCRIPTION OF THE DRAWINGS

An embodiment of the invention in the various aspects noted above will now be described with reference to the figures in which.

DETAILED DESCRIPTION OF THE INVENTION

The embodiment of the invention described is an Inductive Output Tube (IOT) with a multi-stage depressed collector. However, it would be appreciated to the skilled person that the collector arrangement described could equally be used with other linear beam devices such as travelling wave tubes and Klystrons.

Figure 1:
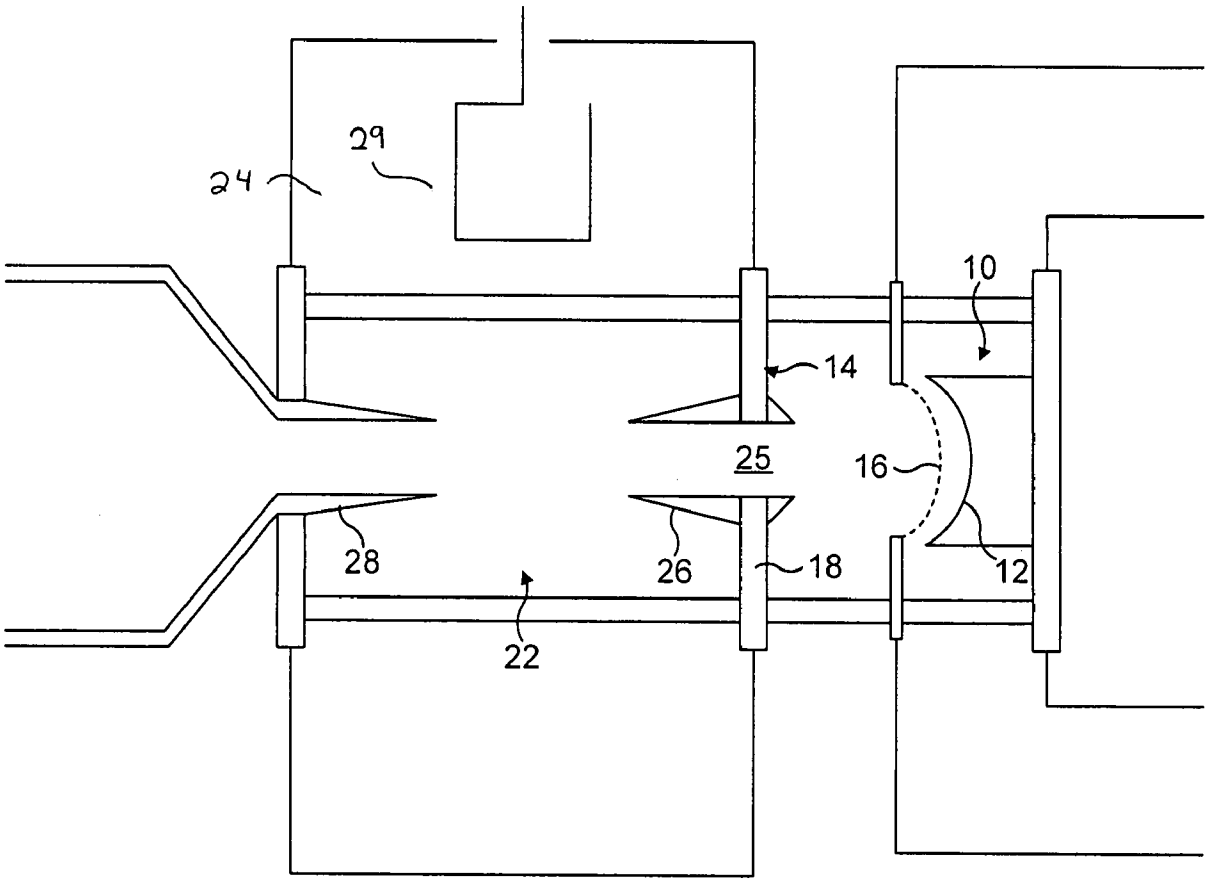
FIG. 1: shows an electron gun, drift tube and RF cavity for use with a multi-stage depressed collector embodying the invention.

An IOT embodying the invention is shown in FIG. 1 and comprises an electron gun 10 for generating an electron beam. The electron beam is created from a heated cathode 12 held at a negative beam potential of around −36 kV and accelerated towards and through an aperture in a grounded anode 14 formed as part of a first portion of a drift tube 22 described later.

A grid 16 is located close to and in front of the cathode and has a DC bias voltage of around −80 volts relative to the cathode potential applied so that, with no RF drive a current of around 500 mA flows. The grid itself is clamped in place in front of the cathode (supported on a metal cylinder) and isolated from the cathode by a ceramic insulator, which also forms part of the vacuum envelope. The RF input signal is provided on an input transmission line between the cathode and grid. The electron gun 10 is coupled to a drift tube and output section 20 by a metallic pole piece 18.

The electron beam generated by the electron gun 10, and density modulated by the RF input signal between cathode 12 and grid 16, is accelerated by the high voltage difference (of the order 30 kV) between the cathode 12 and anode 14 and accelerates into a drift tube 22 of the drift space and output stage 20. The drift tube 22 is defined a first drift tube portion 26 and a second drift tube portion 28 surrounded by an RF cavity defined by an outer wall 23 forming part of the vacuum enclosure with the electron gun and collector assembly. The electron beams passes through a central aperture 25 in the first drift tube portion 26 having a generally disc shaped portion attached to the pole piece 18 and frustoconical section. The drift tube is typically of copper. Connected to the drift tube section 22 is an output cavity 24 containing an output loop 29 via which RF energy in the drift tube section 22 couples and is taken from the IOT.

The electron beam having passed through the drift space and output region 20 still has considerable energy, the full beam voltage being typically 30 kV below ground. It is the purpose of the collector stage 30 to collect this energy, as now described in relation to FIG. 2.

Figure 2:
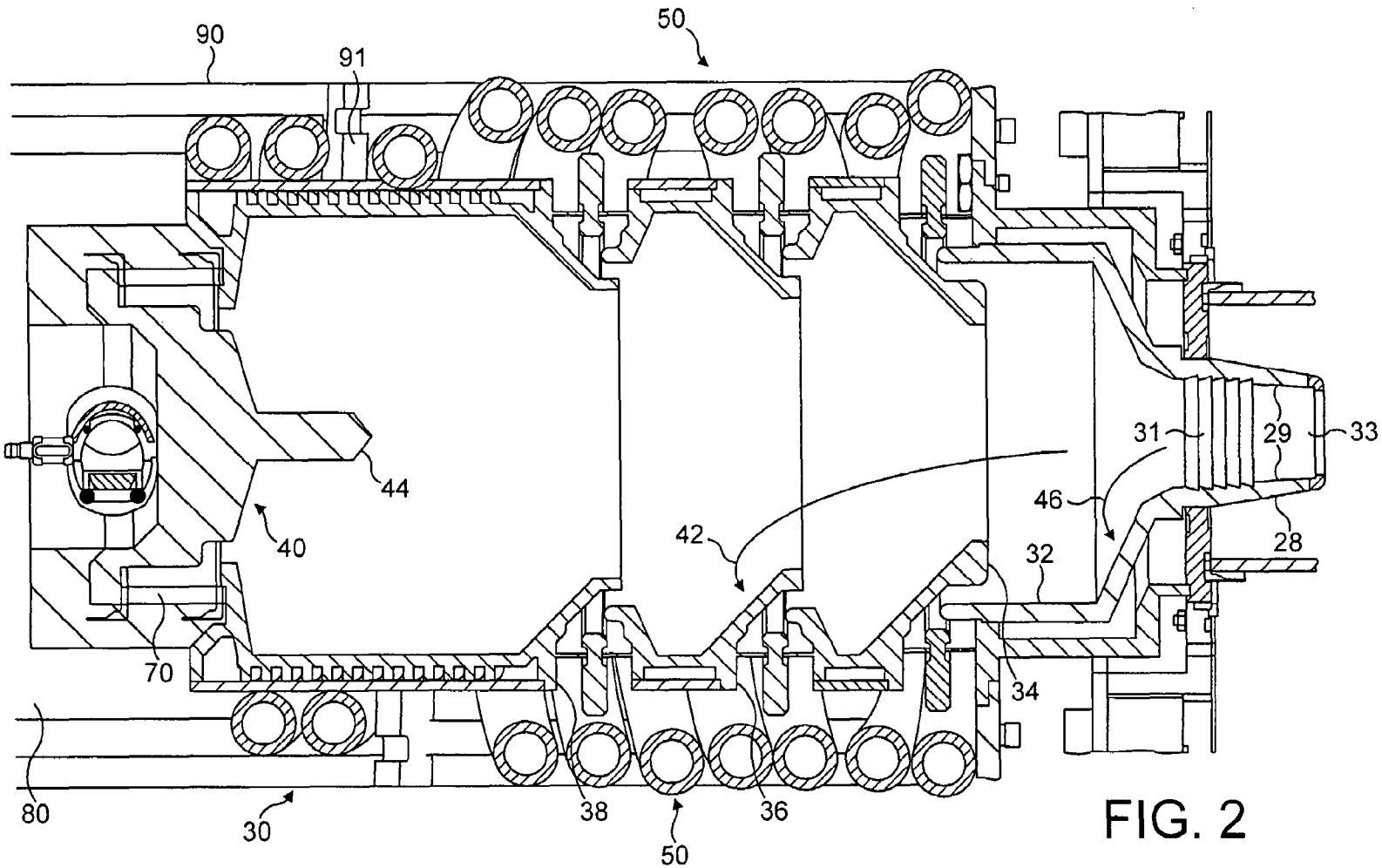
FIG. 2: shows a multi-stage depressed collector embodying the invention.

As shown in FIG. 2, the electron beam enters the collector stage 30 from the drift tube portion 28 via an aperture 33 in an extended wall portion 29 of a first electrode stage 32. The extended portion 29 is of slight frustoconical section with nearly parallel sidewalls 29 defining the aperture 33 through which the electron beam passes and forms the second drift tube portion 28. The collector comprises five electrode stages, a first stage 32, a second stage 34, a third stage 36, a fourth stage 38 and a final fifth stage 40. Each electrode in turn is held at a potential "depressed" from the full beam potential ranging from ground to the full beam potential (the full beam potential being cathode potential). The first electrode stage 32 is grounded at anode potential and the final fifth stage 40 is substantially at cathode potential, with the intermediate second, third and fourth electrode stages 34, 36, 38 ranging between these. Other numbers of electrodes are possible, for example the first and second electrodes may be both at ground potential and so could effectively be combined as a single electrode giving 4 electrodes. Other numbers such as 3 electrodes are also possible.

The advantages of multi-stage depressed collectors for use on TV amplifiers has long been understood. Four and five cavity Klystrons incorporating five stage, water-cooled depressed collectors have been in routine use for many years, and are able to realise figures of merit, (FOM) of 120% or more in vision only service, when the collector efficiency is augmented by BCD pulsing techniques. The benefits of a multi-stage depressed collector on an IOT are, at first sight, not so obvious. The class AB operation of the IOT results in very different electron beam dynamics in a tube that is already very efficient by comparison to a conventional Klystron.

It is generally accepted that the IOT lends itself very well to 8-VSB digital TV transmissions. The inclusion of an RF modulated grid in the construction of the IOT electron gun results in a device that is able to respond very efficiently to the demanding high dynamic range imposed by the 8-VSB signal. Although the typical average output power required from an IOT in digital service is modest, (around 30 kW), the peak powers required are of the order of 130 kW or more. It is the need to transmit these high peak powers that renders the class AB IOT eminently suitable for DTV.

The demands placed on an IOT amplifier by the NTSC signal are very different to those of the digital 8-VSB standard. The dynamic nature of the beam current in analog use, which depends strongly on picture content, means that not only does the amplitude of the beam current vary with time, but so too does the distribution of electron energies entering the collector of the IOT. This is also true for a multi-stage depressed collector IOT or "ESCIOT". As a result, the spent beam current landing on each discrete collector electrode of an MSDC IOT or ESCIOT in analog operation can vary significantly and can sometimes exceed the mean electrode current by a considerable amount. In the case of a conventional IOT, the distribution of energies is largely irrelevant, as all beam current is collected at or near ground potential on the single collector electrode. In the case of the ESCIOT, however, the variation of both beam current and electron velocity results in each individual collector electrode, (and each associated power supply), having to be able to sink much more current than would be the case in digital operation.

As described above, the electron beam comprises electrons having a range of energies, which need to be collected. Electrons having high energy continue on a nearly straight path 44 and are captured by an electrode stage, which is at a high negative potential. In contrast, electrons having lost the majority of their energy to the RF output signal are repelled by the negative potentials of the second, third, fourth and fifth electrode stages and are deflected onto the first electrode at substantially anode potential, as shown by the path 46. The majority of electrons, however, will have potentials ranging between anode and cathode potentials and so will be captured by the second, third or fourth electrodes which are variously at potentials between anode and cathode, a typical path being shown as 42. Electrons can strike anywhere on the interior surface of the collector 30 that is reachable by a feasible path from the drift tube 28 and this depends upon the physical arrangement of the collector and the voltages applied to the different electrodes.

The electrons striking the electrode surfaces cause heating and, for this reason, cooling hoses 50 are provided around the outside of the collector to allow a liquid coolant to be circulated through channels on the outer surface of the various collector electrodes, thereby enabling extraction of heat from the collector to the fluid in the cooling hoses 50. The preferred coolant is water but other high specific heat capacity fluids would do. Typical collector power dissipations are 20 kW for digital amplifiers and 45 kW for analog amplifiers.

One arrangement to deal with such high power dissipations is to increase the size of the collector 30 as a whole. This allows the electron densities to be reduced by spreading the electrons over a larger area. In essence, the electron beam can spread more and so the concentration of energy is reduced when it strikes the electrode surfaces. A constraining factor in prior collector designs is that the collector itself must fit through magnets, which focus the electron beam, during assembly of the IOT. The electron gun, drift tube and collector are assembled and then passed down through a magnet arrangement with the collector at the bottom passing through the magnets. In the present design, in contrast, the collector is arranged above the electron gun and drift tube and so does not have to pass through these magnets, which would constrain the size of the collector. Accordingly, the collector can be larger than prior designs. The design is, therefore, a new multi-stage depressed collector and electron gun arrangement in which the collector is mounted over the electron gun and does not pass through a magnet arrangement in assembly.

We have appreciated the need to reduce emission of secondary electrons from any of the electrode surfaces within the collector. A secondary electron emission refers to electrons that are knocked out of the metal material of the collector electrodes by the impact of an energetic electron. Such secondary electrons could be accelerated back into the drift tube 28 by the electric fields within the collector 30. Accordingly, the first aspect of the invention provides a coating on some or all of the electrode surfaces within the collector having low secondary electron emission characteristics. Typically, electrodes are formed of copper. Copper is used as the main characteristics required of the electrode bulk material are high electrical conductivity to sink the electron beam current and high thermal conductivity to dissipate heat generated by the current. By using the first aspect of the invention, copper electrodes can be coated with a material of a low secondary electron emission characteristics such as titanium, titanium nitride or carbon. Low secondary electron emission properties include a low number of electrons emitted when incident electrons strike the surface and can be defined by the secondary electron coefficient. The secondary electron coefficient is the ratio of released to incident electrons. For copper this can be greater than unity. The desired properties are that the coating has a lower secondary electron coefficient than the bulk material of the electrode, and preferably less than unity.

The preferred choice is to deposit a titanium nitride coating on at least the second, third and fourth electrodes where the incident energy of electrons is high. The deposition process could be by plating, chemical vapour deposition, painting, spraying or evaporating, but the preferred process is sputtering, as this is a relatively low cost and fast process and provides the characteristics required. The coating layer is preferably a few microns thick, typically 0.5 to 2 microns.

To improve the durability of the coating, an intermediate layer could be coated on the copper electrode surface prior to coating with titanium to reduce the possibility of the titanium diffusing into the copper electrode.

We have appreciated it may be beneficial to selectively coat different electrodes on the interior surface of the collector with different coatings, though the preferred choice is to coat the whole interior surface of the collector. One example of this is that titanium is a good "getter". A "getter" is a material, which has properties for collecting gas. Whilst, in theory, the interior of the collector is a vacuum, there will always be some molecules of gas remaining and by coating one or more interior surfaces with a "getter", these can be retained at the electrode surface.

"Getters" can be evaporable or non-evaporable. An evaporable "getter" can allow gas to be released again, whereas a non-evaporable "getter" retains the gas. The importance of retaining gas, whether by evaporable or non-evaporable "getter" is to avoid electrons in the high energy electron beam bombarding gas molecules and producing ions, which would bombard and harm the cathode as a result.

Preferably, the "getter" is not deposited in regions where there is high electron bombardment. This is because the electron bombardment causes heating and so could allow re-emission of the gas molecules retained by the "getter". Accordingly, preferably the first electrode, stage 32, and fifth electrode, stage 40, are coated with a "getter" material.

These electrodes have lower energy bombardments and so suffer less heating than the second, third and fourth electrodes. The preferred arrangement is thus to have a good "getter" material coating the first and last electrode stages and a good material with low secondary electron emission characteristics coating any or all of the intermediate electrode stages. The preferred choices are coating the first and fifth electrodes with titanium and the second, third and fourth electrodes with titanium nitride. In extreme, a different coating could be used for each electrode, or even each portion of an electrode, depending upon the surface characteristics required, as determined by analysis of the electron paths and energies within the collector. The last electrode stage is the preferred choice for coating with the surface layer of an effective getter because this electrode both suffers a low incident electron bombardment (and so is heated less than other electrodes) and is also the most negative electrode so any positive ions of gas in the vacuum envelope are most attracted to this electrode.

Figure 3:
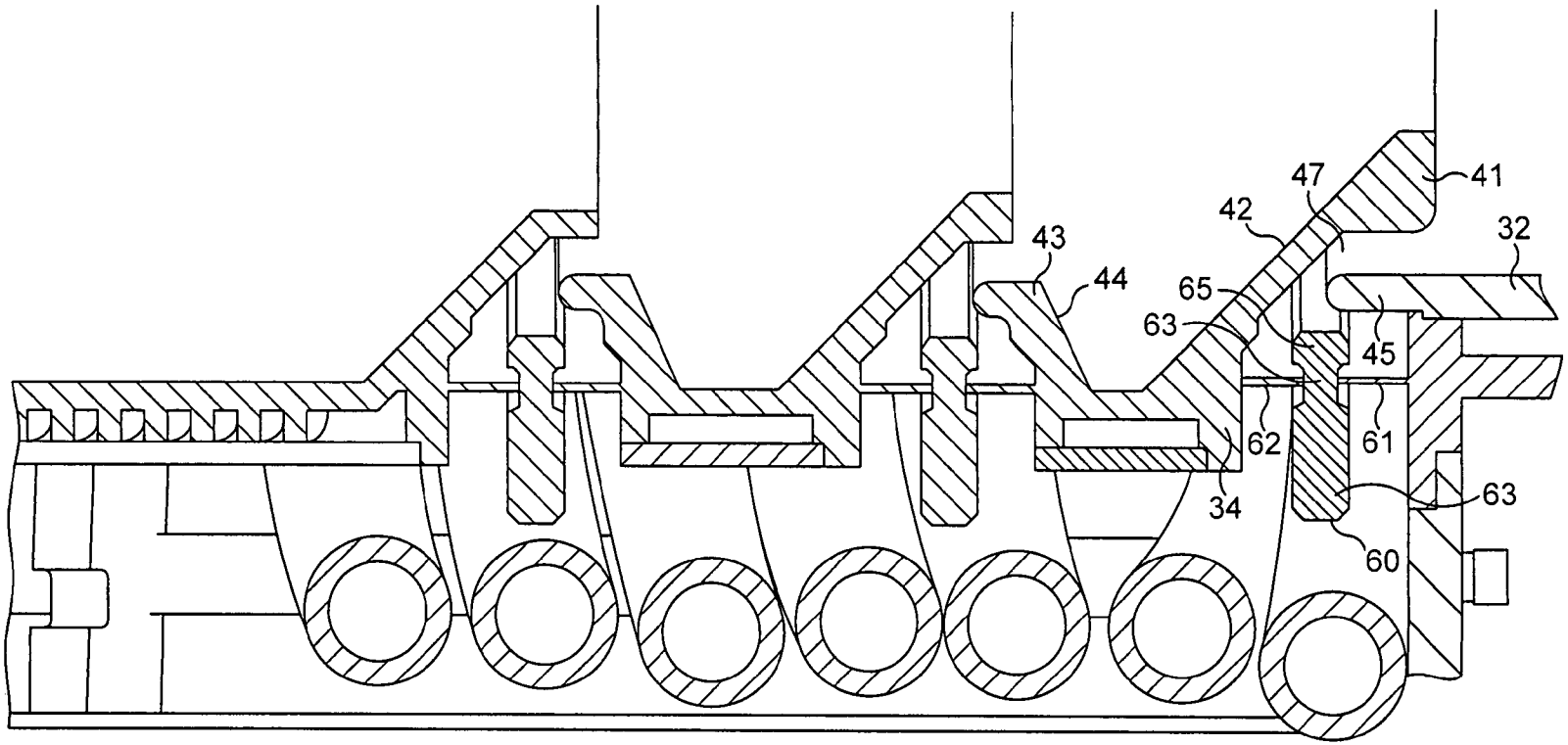
FIG. 3: is a detailed view of the collector electrodes of FIG. 2.

The electrode configuration itself will now be described with reference to FIG. 3. As shown in FIG. 3, the second, third and a portion of the fourth electrodes are shown in greater detail. The second electrode 34 comprises a first portion 41 extending generally in the direction of the drift tube and defining a first surface 42 generally facing away from the drift tube and towards the middle of the collector. It is this surface 42 which provides the majority of the electron collection for this electrode. A second portion 43 of the electrode 34 extends in the opposite direction generally towards the next electrode. This defines a second surface 44, which also provides electron capture. The whole electrode 44 is held at a given potential between anode and cathode potential, for example, 8 kV above ground. There is thus a high voltage difference in this case of around 8 kV between the first portion 41 of the second electrode 34 and the end 45 of the first electrode 32, which is at ground. There is thus a need for an electrically insulating gap between these two electrodes. For this reason, an insulating spacer 60 is provided of non-electrically-conducting material, preferably ceramic, which insulates each electrode from the other. This is fixed between a first extending wall 61 of the first electrode 32 and a second extending wall 62 of the second electrode 34, so as to define a vacuum on the interior side of the collector providing a gas seal. A waisted portion 63 of the insulating spacer 60 is held between the two walls 61, 62.

We appreciated the need to prevent high-energy electrons from bombarding the insulating spacer 60, as this would potentially allow high-energy electrons out of the collector cavity or to bombard areas of thin metal such as the walls 61, 62 extending between the electrodes defining the vacuum envelope thereby producing X-rays or damage to the walls. For this reason, the first portion 41 of the second electrode 34 and the end wall 45 of the first electrode 32 are arranged in overlapping relationship such that there is no feasible path there between for an electron to pass. By feasible path is meant that an electron cannot negotiate the labyrinth passage through the gap 47 because the fields acting on the electron do not allow it to change direction from a smooth curve heading from the drift tube towards the electrodes. There is effectively no line of sight for an electron from the electron gun. To pass through the gap 47 between the first and second electrodes would require an electron to turn abruptly away from a smooth curved path. The insulating spacer 60 and extending walls 61, 62 are thereby shielded by the overlapping regions 45 and 41 of the first and second electrodes, which define such a path.

A similar arrangement of non-conductive spacer and overlapping regions of electrodes exists between each of the second and third, and third and fourth electrodes (referring back to FIG. 2). A similar arrangement also exists between the fourth electrode and fifth electrode with a ceramic spacer 70 in a physically different but functionally similar configuration. Other arrangements of electrode walls are possible, for example interleaved or overlapping radially rather than axially.

The choice of spacer arrangement 60 can also be made with reference to the needs of DC voltage hold off and RF performance. The spacer is typically ceramic, preferably alumina. As can be seen, the spacer 60 comprises a longer portion 64 outside the vacuum envelope and a shorter portion 65 within the envelope with the waisted portion 63 between. Such an arrangement makes efficient use of the material as there is a shorter physical path length between the ends of walls 61 and 62 within the vacuum but a longer physical path length around the ceramic spacer outside of the vacuum. This is required as a longer path length is required in a gas in comparison to a vacuum to hold off the same voltage without the gas breaking down and becoming a conductor. The shape of the spacer 60 also minimises the intrusion of the spacer into the collector cavity and minimises the length of material required in the axial direction of the collector. This allows a compact collector design. In essence, the spacer shape has a longer radial length than normal and allows a long path length for voltage hold off without requiring a longer axial length of the whole collector.

The waisted portion also serves an electrical function of providing a physical barrier to the high DC voltage but a short circuit to radio frequencies. This can be achieved by a conductive surface of the spacer 60 at the waisted portion 63 in contact with the walls 61 and 62. In essence, this acts as a capacitor across the waisted portion providing a DC open circuit but a radio frequency short circuit determined by the capacitance provided The choice of shape of the waisted portion is important for electrical characteristics. The capacitor formed by coating with a metal at this region is thin and so at the edges of the coating has a high radius of curvature (a sharp edge). This creates a high field and could encourage corona discharge. However, it is noted that the waisted portion has a surface which is directed in the direction of the respective electrodes on either side. The voltage applied to each side of the plated portion is the same as the voltage on the respective electrode towards which the coated surface is directed. Accordingly, any risk of corona discharge is minimised because there is no high voltage difference between the edge of the coated surface and electrode towards which the respective edge of the coated surface "points".

The metallic surfaces on the waisted portion are preferably formed by established ceramic metallising techniques, which then facilitate brazing to the walls 61 and 62. This choice is preferred as it allows the whole collector assembly of electrodes or at least some of the electrodes to be assembled and then all connections between the electrodes and spacers to be formed by brazing at the same time.

Figure 4:
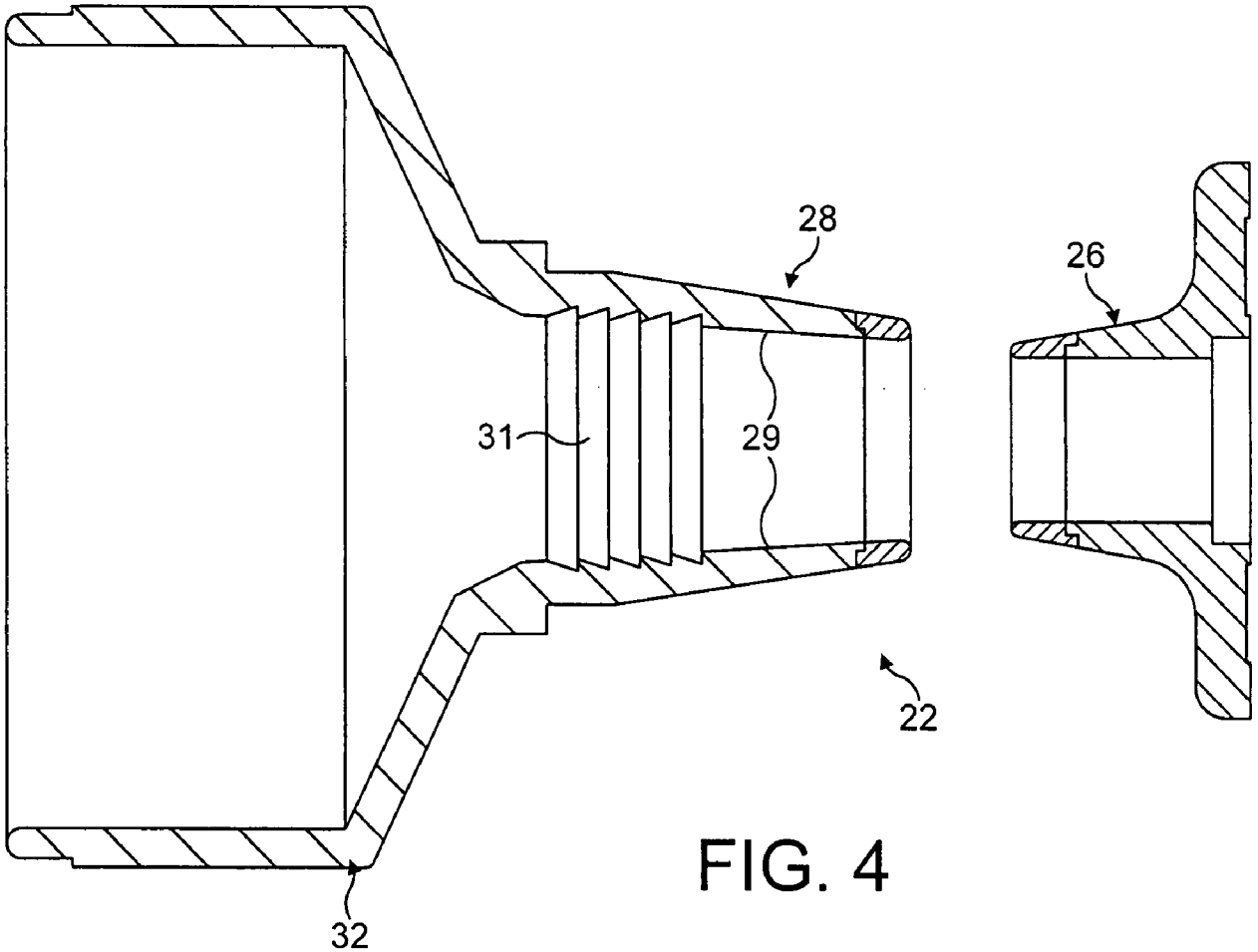
FIG. 4: is an expanded view of the second drift tube portion and first collector electrode.

We have further appreciated that, in spite of the precautions to prevent secondary electron emissions, it remains possible for secondary electron emission to occur. In the event that secondary electron emission does occur, then it is important for the electrons to be recaptured rather than to be retracted into the RF cavity or to the anode. The energy of any secondary electrons will depend upon various factors, including the energy of the incident electron which caused the secondary emission and the potential of the electrode for which the secondary emission occurs. We have appreciated that a mechanism for reducing the occurrence of secondary electrons entering the RF cavity is to reduce the aperture of the second drift tube portion 28 so as the increase the likelihood that secondary electrons are captured by that second drift tube portion which is substantially at ground potential. A drift tube portion as part of a first collector electrode embodying this aspect is shown in FIG. 4.

As previously explained, the drift tube 22 comprises a first drift tube portion 26 mounted to the electron gun arrangement, a second drift tube portion 28 formed as part of the first electrode stage 32, there being a gap between the first drift tube portion and second drift tube portion, allowing interaction with the RF output cavity by which the output energy is extracted. The drift tube portions are typically of copper. The second drift tube portion 28 has interior walls 29 which, we have appreciated, should define a relatively narrow aperture in contrast to prior known arrangements used with IOTs. The walls 29 are nearly parallel, diverging slightly in the direction of travel of the electron beam. The width of the aperture defined by the interior walls 29 is nearly the same as the width of the aperture of the first drift tube portion 26. The interior walls 29 are, therefore, nearly cylindrical having a slight frustoconical shape. Such an arrangement is known to the inventors for Klystrons, but not for IOTs. The second drift tube portion being relatively narrow allows it to fit through a magnetic pole piece thus allowing the second drift tube portion to be formed as part of the first electrode stage.

Additional features are provided in the second drift tube portion 28 in that the interior surface 29 includes a series of features best described as serrations 31. The function of these features is to enhance collection of secondary electrons travelling from the collector towards the electron gun. By creating features, which have a surfaces facing towards the collector electrons striking these surfaces are more likely to be captured and less likely to be reflected from the interior surface of the drift tube into the RF region. Electrons striking a flat surface at an angle can either be reflected at a similar angle in the manner of a reflected ray, or can create a secondary electron which may be emitted in the same direction of travel as the incident electron. In known devices this means that secondary electrons could simply continue in a path towards the anode even if they strike the inner wall of the second drift tube portion. In contrast, by having portions of the surface of the drift tube wall which have a perpendicular axis generally in the direction of the collector, incident electrons are encouraged to be captured or reflected back in the direction of the collector.

A further aspect of the invention relates to the frequency performance of the high voltage coupled to each of the individual electrode stages. A multi-stage depressed collector requires connection from each electrode to a high voltage source. In the present example, the first collector 32 is substantially at ground (anode potential), the second electrode stage 34 at 8 kV, the third electrode stage 36 at 18 kV, the fourth electrode stage 38 at 24 kV and the final electrode stage at 40 kV. Each of these voltages is provided by a high voltage supply connected via coupling leads (not shown), which extend out of the enclosure of the whole collector arrangement in a space 80 at the rear of the final collector stage. We have appreciated that the RF performance of the electrodes can be improved not only by the capacitance provided between the electrodes by the spacer 60 previously described, but also by the connections between electrodes from the high voltage source. To improve performance, the embodiment provides lumped components between the HV leads whether inductive or capacitative coupling to provide a decoupling choke between the HV leads leading to each electrode. This allows filtering of frequencies at Baseband.

In a final aspect, the inventors appreciated that the whole collector assembly and, indeed, the whole linear beam device requires transportation. Turning again to FIG. 2, it can be seen that the whole collector sits within a housing or can 90, which must, in use, be substantially at ground potential, so as to avoid dangerous high voltages being exposed. Between the electrodes and the outer can wall 90 is an arrangement of flexible tubes 50, which provide the cooling arrangement around the outside of the collector. However, these do not provide support for the collector within the housing 90. Accordingly, an additional non-conductive support element 91 is provided which acts as a spacer between the outer wall of the electrodes and the inner wall of the housing 90. This allows the electrode arrangement to be maintained fixed within the can whilst keeping sufficient gap and voltage hold off that the outer can does not take the high voltage of the inner electrodes. This spacer 91 is contrasted to earlier arrangements in which either no support is provided or support is provided by the cooling arrangement itself. In essence, a collector with a non-supportive cooling arrangement and a separate supportive spacer is provided.

The various aspects of the embodiment of the invention may, of course, be used separately in an embodiment or in any combination to improve the performance as described above. In addition, the aspects may be embodied in a collector for any linear beam device, including a Klystron, travelling wave tube or an IOT, except where specifically stated.

The invention has been described in detail with respect to exemplary embodiments, and it will now be apparent from the foregoing to those skilled in the art, that changes and modifications may be made without departing from the invention in its broader aspects, and the invention, therefore, as defined in the appended claims, is intended to cover all such changes and modifications that fall within the true spirit of the invention.

What is claimed is:

1. A collector for an electron beam tube comprising a plurality of electrode stages, the electrode stages being spaced from one another by a non-conductive spacer, the non-conductive spacer being located between portions of electrodes and extending into the collector on a first side and out of the collector on a second side, wherein the non-conductive spacer has an inner portion extending into the collector and an outer portion extending out of the collector, and a waisted portion there between, the spacer being held at the waisted portion.

2. The collector according to claim 1, wherein the physical path length around the spacer is shorter on the first side than on the second side.

3. The collector according to claim 1, the collector having an axial direction and a radial direction, wherein the non-conductive spacer extends in the radial direction more than in the axial direction.

4. The collector according to claim 1, the non-conductive spacer being coated on both sides with a conductive layer at the waisted portion so as to define a capacitor.

5. The collector according to claim 4, wherein the capacitor acts as a DC open circuit and RF closed circuit.

6. The collector according to claim 4, wherein the conductive layer on each side of the waisted portion is electrically connected to a respective adjacent electrode.

7. The collector according to claim 4, wherein the conductive layer on both sides has edges, the edges being directed in the direction of the respective adjacent electrode to which the layer on each side is electrically connected.

8. The collector according to claim 1, the spacer being of ceramic.

9. The collector according to claim 1, comprising an interior surface for collection of electrons comprising one or more electrode stages, the interior surface having a surface layer of low secondary electron emission characteristic on all or part of the interior surface.

10. The collector according to claim 9, the collector having a plurality of electrode stages, the surface layer of low secondary electron emission characteristic being on one or more of the plurality of electrode stages.

11. The collector according to claim 9, the collector having a first electrode stage, a last electrode stage and one or more intermediate electrode stages, the surface layer of low secondary electron emission characteristic being on the one or more intermediate electrode stages.

12. The collector according to claim 9, the collector having five electrode stages, the surface layer of low secondary electron emission being on the second, third and fourth electrode stages.

13. The collector according to claim 1, for an electron beam tube comprising a plurality of electrode stages, electrode stages of the plurality of electrode stages being spaced from one another and having walls extending so as to define a gap there between, the walls being arranged so that there is no feasible electron path through the gap.

14. The collector according to claim 13, adjacent electrode stages having gap defining walls extending towards one another, the gap defining walls having an overlapping relationship.

15. The collector according to claim 13, the non-conductive spacer being shielded from electron bombardment by the walls defining the gap.

16. The collector according to claim 13, the walls being arranged so that electrons cannot strike metallic surfaces outside the collector cavity thereby minimising risk of X-ray liberation outside the cavity.

17. The collector according to claim 1, the collector comprising a plurality of electrode stages and a drift tube, the drift tube being relatively narrow in comparison to prior arrangements.

18. The collector according to claim 1, wherein the drift tube has surface features so designed to enhance secondary electron capture.

19. The collector according to claim 1, wherein the surface features have portions which face generally in the direction of the collector.

20. The collector according to claim 1, wherein the surface features form serrations.

21. The collector according to claim 1, comprising a plurality of electrode stages each electrode stage being connected via a separate high voltage lead, the high voltage leads being coupled together or to ground so as to remove unwanted RF frequencies.

* * * * *